US012454781B2

(12) United States Patent
Zhao

(10) Patent No.: US 12,454,781 B2
(45) Date of Patent: Oct. 28, 2025

(54) WASHING AND DRYING ALL-IN-ONE MACHINE AND CONTROL METHOD THEREFOR

(71) Applicants: QINGDAO HAIER DRUM WASHING MACHINE CO., LTD., Shandong (CN); Haier Smart Home Co., Ltd., Shandong (CN)

(72) Inventor: Xinfeng Zhao, Qingdao (CN)

(73) Assignees: QINGDAO HAIER DRUM WASHING MACHINE CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 149 days.

(21) Appl. No.: 18/552,298

(22) PCT Filed: Mar. 29, 2022

(86) PCT No.: PCT/CN2022/083679
§ 371 (c)(1),
(2) Date: Sep. 25, 2023

(87) PCT Pub. No.: WO2022/206756
PCT Pub. Date: Oct. 6, 2022

(65) Prior Publication Data

US 2024/0060227 A1 Feb. 22, 2024

(30) Foreign Application Priority Data

Mar. 31, 2021 (CN) ..... 202110351448.8

(51) Int. Cl.
*D06F 33/70* (2020.01)
*D06F 25/00* (2006.01)
(Continued)

(52) U.S. Cl.
CPC ..... *D06F 33/70* (2020.02); *D06F 25/00* (2013.01); *D06F 33/56* (2020.02); *D06F 33/58* (2020.02);
(Continued)

(58) Field of Classification Search
CPC ..... D06F 25/00; D06F 33/56; D06F 33/58; D06F 33/60; D06F 33/68; D06F 33/70;
(Continued)

(56) References Cited

U.S. PATENT DOCUMENTS 7,624,466 B2 * 12/2009 Kim ..... D06F 29/00 8/159
10,577,741 B2 * 3/2020 Bae ..... D06F 29/005
(Continued)

FOREIGN PATENT DOCUMENTS

CN 1648320 A 8/2005
CN 208136534 U 11/2018
(Continued)

OTHER PUBLICATIONS

International Search Report mailed on Jun. 22, 2022 in corresponding International Application No. PCT/CN2022/083679; 4 pages.

*Primary Examiner* — Joseph L. Perrin
(74) *Attorney, Agent, or Firm* — Maier & Maier, PLLC

(57) ABSTRACT

A washing and drying all-in-one machine and a control method therefor. The control method includes: when a washing and drying all-in-one machine enters a washing-drying linkage mode, measuring a remaining time of a washing program, and determining whether the remaining time is within a preset first time threshold value; and if so, a clothes dryer matching a drying program corresponding to the clothes and performing preheating, and after waiting for the washing program to end, the washed clothes being placed in the clothes dryer for drying. By the washing and
(Continued)

drying all-in-one machine and the control method therefor, according to the remaining time of the washing program, the clothes dryer is started in advance to execute a drying program and is preheated, such that the entire washing-drying time consumption of the clothes is shortened, thereby improving the user experience, and meeting the increasing intelligent requirements of users.

8 Claims, 2 Drawing Sheets

(51) Int. Cl.

| | |
|---|---|
| ***D06F 33/56*** | (2020.01) |
| ***D06F 33/58*** | (2020.01) |
| ***D06F 33/60*** | (2020.01) |
| ***D06F 33/68*** | (2020.01) |
| ***D06F 34/18*** | (2020.01) |
| *D06F 103/06* | (2020.01) |
| *D06F 103/38* | (2020.01) |
| *D06F 105/30* | (2020.01) |
| *D06F 105/32* | (2020.01) |
| *D06F 105/52* | (2020.01) |
| *D06F 105/54* | (2020.01) |
| *D06F 105/56* | (2020.01) |
| *D06F 105/58* | (2020.01) |

(52) U.S. Cl.
CPC ..... *D06F 33/60* (2020.02); *D06F 33/68* (2020.02); *D06F 34/18* (2020.02); *D06F 2103/06* (2020.02); *D06F 2103/38* (2020.02); *D06F 2105/30* (2020.02); *D06F 2105/32* (2020.02); *D06F 2105/52* (2020.02); *D06F 2105/54* (2020.02); *D06F 2105/56* (2020.02); *D06F 2105/58* (2020.02)

(58) Field of Classification Search
CPC .. D06F 34/18; D06F 2103/06; D06F 2103/38; D06F 2105/30; D06F 2105/32; D06F 2105/52; D06F 2105/54; D06F 2105/56; D06F 2105/58
See application file for complete search history.

(56) References Cited

U.S. PATENT DOCUMENTS

| | | | | |
|---|---|---|---|---|
| 10,745,841 | B2 * | 8/2020 | Yoon | G06F 3/0482 |
| 12,037,731 | B2 * | 7/2024 | Lee | D06F 29/005 |
| 2004/0118008 | A1 * | 6/2004 | Jeong | D06F 34/04 34/445 |
| 2020/0024784 | A1 | 1/2020 | Yoon et al. | |
| 2022/0364289 | A1 * | 11/2022 | Holzen | D06F 33/60 |

FOREIGN PATENT DOCUMENTS

| | | | |
|---|---|---|---|
| DE | 102018100442 | A1 | 7/2019 |
| EP | 3889336 | A1 | 10/2021 |
| EP | 3889337 | A1 | 10/2021 |

* cited by examiner

WASHING AND DRYING ALL-IN-ONE MACHINE AND CONTROL METHOD THEREFOR

FIELD

The present disclosure belongs to the technical field of washing apparatus, and specifically provides a washing-drying integrated machine and a control method therefor.

BACKGROUND

With the improvement of living standards, people's demands on washing apparatuses are also increasing. At home, not only washing machines capable of washing clothing are provided, but also clothing dryers capable of sterilizing and drying are provided.

There is a lack of association between existing washing machines and clothing dryers, so they require separate control by users. For example, when the user uses the washing machine to wash the clothing, the clothing dryer is usually started for drying the clothing only after completion of clothing washing. Before formally starting a drying program in common clothing dryers in the market, the clothing dryers have to be preheated, which will take a certain period of time.

Therefore, when using the washing machines and clothing dryers mentioned above to wash and dry the clothing, an overall time consumption is relatively large, and the user experience is poor, so that the growing intelligentization needs of users cannot be met.

SUMMARY

In order to solve the above problem in the prior art, the present disclosure provides a washing-drying integrated machine and a control method therefor, which can solve the problem of large overall time consumption when existing washing machines and clothing dryers are used to wash and dry the clothing.

In a first aspect, the present disclosure provides a control method for a washing-drying integrated machine, in which the washing-drying integrated machine includes a washing machine and a clothing dryer that are integrated, and has a washing and drying co-working function key, and when the washing and drying co-working function key is selected, the washing machine and the clothing dryer can enter a washing and drying co-working mode;

the control method includes:

obtaining the material and/or type of clothing in a case where the washing-drying integrated machine enters the washing and drying co-working mode;

executing a washing program corresponding to the material and/or type of the clothing;

detecting a remaining running time of the washing program;

judging whether the remaining running time of the washing program is smaller than or equal to a preset first time threshold; if yes, proceeding to the next step; and if not, making the clothing dryer enter a standby state;

matching the clothing dryer with a drying program corresponding to the material and/or type of the clothing;

preheating the clothing dryer according to the drying program;

detecting whether the washing program has ended; if yes, sending a clothing drying prompt; and making the clothing dryer execute the drying program in a case where the washed clothing is transferred to the clothing dryer.

In a preferred technical solution of the control method described above, before the step of "preheating the clothing dryer according to the drying program" and after the step of "matching the clothing dryer with a drying program corresponding to the material and/or type of the clothing", the control method further includes:

further detecting the remaining running time of the washing program;

judging whether the remaining running time of the washing program is smaller than or equal to a preset second time threshold;

if yes, preheating the clothing dryer according to the drying program; and if not, preparing the clothing dryer for preheating, where the second time threshold is smaller than the first time threshold.

In a preferred technical solution of the control method described above, the clothing dryer includes a fan and a drying cylinder, and the fan is used to convey hot air into the drying cylinder;

in a specific way of preheating the clothing dryer according to the drying program, the fan operates at a high speed and the drying cylinder rotates; and in a specific way of preparing the clothing dryer for preheating, the fan operates at a low speed and the drying cylinder does not rotate.

In a preferred technical solution of the control method described above, the washing program includes a spinning program; and in the step of "further detecting the remaining running time of the washing program":

the further detected remaining running time of the washing program is a preset running time of the spinning program minus the current running time of the spinning program.

In a preferred technical solution of the control method described above, the washing program includes a rinsing program; and in the step of "detecting a remaining running time of the washing program":

the detected remaining running time of the washing program is a preset running time of the rinsing program minus the current running time of the rinsing program.

In a preferred technical solution of the control method described above, clothing information of historical clothing and corresponding historical drying programs are stored in the washing-drying integrated machine; and the step of "matching the clothing dryer with a drying program corresponding to the material and/or type of the clothing" includes:

judging whether the material and/or type of the clothing belongs to the historical clothing;

if yes, obtaining a historical drying program of the current clothing locally by the clothing dryer; and if not, obtaining a drying program that matches the current washing program from a cloud by the clothing dryer.

In a preferred technical solution of the control method described above, the step of "obtaining a drying program that matches the current washing program from a cloud by the clothing dryer" specifically includes:

uploading the material and/or type of the clothing to a cloud; and downloading a drying program corresponding to the material and/or type of the clothing from the cloud.

In a preferred technical solution of the control method described above, the washing-drying integrated machine further includes a reminder device; and in the step of "sending a clothing drying prompt", when the washing program has ended, the reminder device sends a reminder message to remind the user that the clothing can be dried.

In a second aspect, the present disclosure provides a washing-drying integrated machine, which includes a memory and a processor, and a control program for the washing-drying integrated machine that can be run on the processor is stored in the memory; and when the control program is executed by the processor, the control method as described in the first aspect is implemented.

In a preferred technical solution of the washing-drying integrated machine described above, the washing-drying integrated machine further includes a control unit; and a washing cylinder of the washing machine and a drying cylinder of the clothing dryer are in signal connection with the control unit respectively, and the control unit can separately control the washing cylinder and the drying cylinder to rotate.

As compared with the prior art, the washing-drying integrated machine and the control method therefor provided by the present disclosure have the following advantages.

In the washing-drying integrated machine and the control method therefor provided by the present disclosure, the washing-drying integrated machine is provided with a washing and drying co-working function key. When the washing and drying co-working function key is selected, the washing machine and the clothing dryer can enter a washing and drying co-working mode. In a case where the washing-drying integrated machine enters the co-working mode, a remaining time of the washing program is detected, and it is judged whether the remaining time is smaller than a preset first time threshold; if yes, the clothing dryer is matched with the drying program corresponding to the clothing and is preheated; and after the washing program has ended, the washed clothing can be placed in the clothing dryer for drying.

In the prior art, there is a lack of association between the clothing dryer and the washing machine. Users usually need to start the clothing dryer for preheating and clothing drying only after the washing machine has finished clothing washing. Due to the long preheating time of the clothing dryer, the entire washing-drying cycle is longer. As compared with the prior art, the control method provided by the present disclosure can link the washing machine with the clothing dryer, and can start the drying program in advance for preheating according to the remaining time of the washing program, thereby reducing the entire washing-drying time consumption of the clothing, improving the user experience, and meeting the growing intelligentization needs of users.

DETAILED DESCRIPTION

Preferred embodiments of the present disclosure will be described below with reference to the accompanying drawings. It should be understood by those skilled in the art that these embodiments are only used to explain the technical principle of the present disclosure, and are not intended to limit the scope of protection of the present disclosure.

Figure 1:
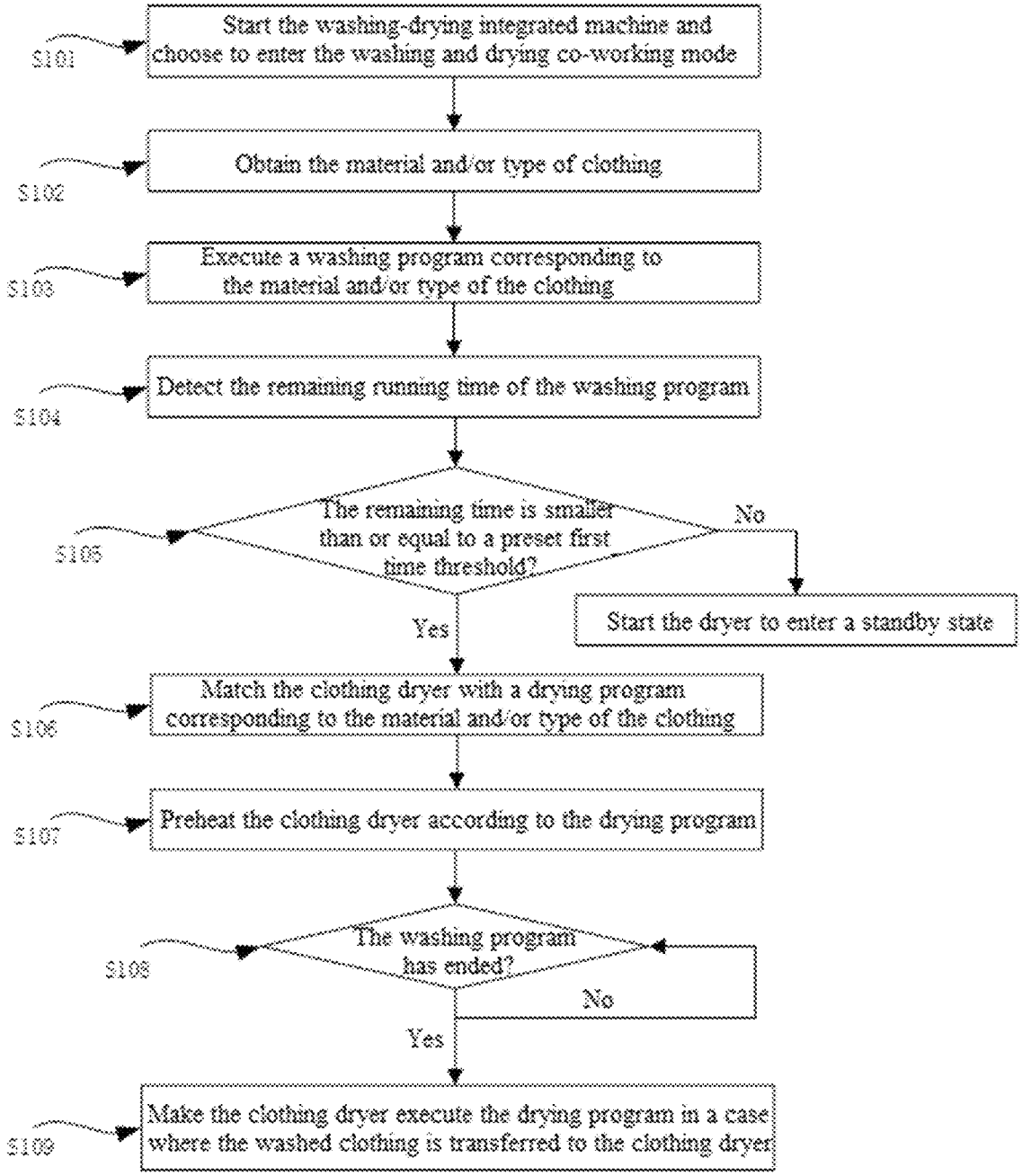
FIG. 1 is a schematic flowchart of the control method for a washing-drying integrated machine provided by an embodiment of the present disclosure.
Figure 2:
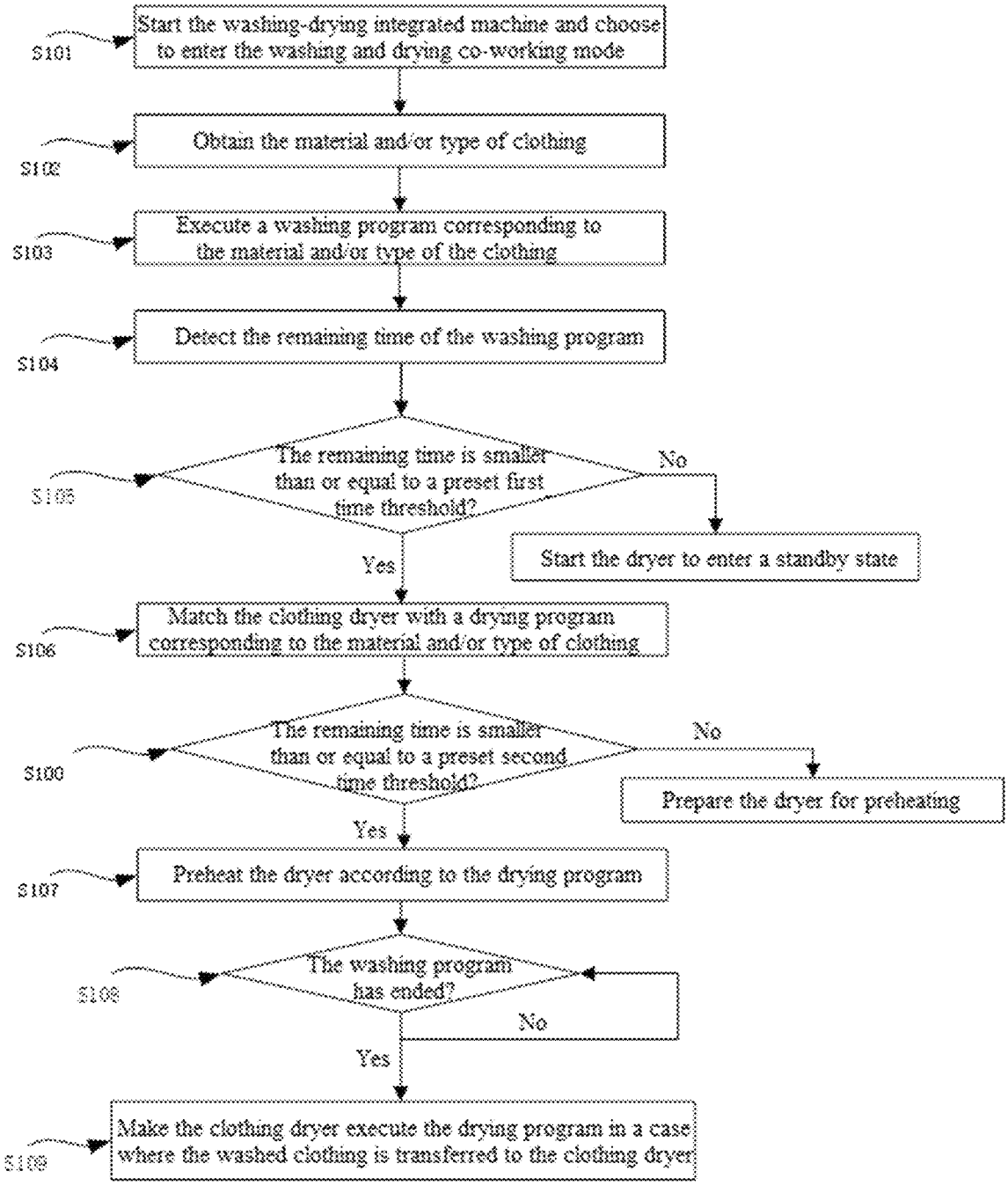
FIG. 2 is a schematic flowchart of the control method for a washing-drying integrated machine provided by an embodiment of the present disclosure.

As shown in FIG. 1, an embodiment of the present disclosure provides a control method for a washing-drying integrated machine, which can link a washing program and a drying program in the washing-drying integrated machine, and control the drying program to enter preheating in advance according to the progress of the washing program, thereby saving preheating time and shortening the entire washing-drying cycle.

Specifically, the washing-drying integrated machine provided by the embodiment of the present disclosure includes a control unit, a cabinet, as well as a washing machine and a clothing dryer that are arranged inside the cabinet; the washing machine and the clothing dryer are integrated inside the cabinet, and are in signal connection with the control unit respectively. The control unit can control the washing machine and the clothing dryer separately so that the washing machine independently executes the washing program and the clothing dryer independently executes the drying program.

It can be understood that the washing machine includes a washing cylinder and a driving device that drives the washing cylinder to rotate, and the clothing dryer includes a drying cylinder and a driving device that drives the drying cylinder to rotate. The control unit can be separately in signal connection with the driving device of the washing machine and the driving device of the clothing dryer, so as to achieve the purpose of controlling the washing cylinder and the drying cylinder to rotate respectively.

Further, the washing-drying integrated machine also has a washing and drying co-working function key. When the washing and drying co-working function key is selected, the washing machine and the clothing dryer of the washing-drying integrated machine can enter a washing and drying co-working mode, so that the washing program of the washing machine is associated or linked with the drying program of the clothing dryer, and the timing of the drying program entering preheating can be adjusted according to the progress of the washing program.

It can be understood that the washing-drying integrated machine provided by this embodiment also includes a memory and a processor. Clothing information of historical clothing and washing and drying programs corresponding to the clothing can be stored in the memory. For example, each piece of clothing has an RFID tag that represents its own clothing information, which can include the material, type and the like of the clothing. The washing-drying integrated machine is provided with an RFID recognition system that can recognize the RFID tags of the clothing, thereby obtaining the clothing information and pre-storing it in the memory to form a database.

In addition, the memory also has a control program for controlling the washing-drying integrated machine, which includes but is not limited to the washing program and the drying program; the control program can be executed by the processor. When the control program is executed by the processor, the control method for the washing-drying integrated machine described in this embodiment can be implemented.

As shown in FIG. 1, based on the above washing-drying integrated machine, the control method for the washing-drying integrated machine provided by this embodiment includes the following steps.

Step S101: starting the washing-drying integrated machine and choosing to enter the washing and drying co-working mode.

Specifically, a power supply of the washing-drying integrated machine is turned on so that the washing-drying integrated machine is in a powered-on state. Users can select the washing and drying co-working function key, so that the washing-drying integrated machine enters the washing and drying co-working mode to establish an association between the washing program and the drying program.

It can be understood that in an embodiment, the washing and drying co-working function key provided in the washing-drying integrated machine is a mechanical key, and users can press the mechanical key to activate the washing and drying co-working mode. Alternatively, in another embodiment, a mobile terminal in IoT (Internet of things) connection with the washing-drying integrated machine can be operated. The mobile terminal is provided with an operation area corresponding to the washing and drying co-working function key, and by applying an operation command on the operation area, the washing-drying integrated machine can enter the washing and drying co-working mode.

Step S102: obtaining the material and/or type of clothing.

Specifically, each piece of clothing has its own RFID tag, on which corresponding clothing information is recorded. The above clothing information may include the material and/or type of clothing, etc. Further, the obtained clothing information can be stored in the memory (local database) of the washing-drying integrated machine, so as to match the washing program and drying program for the clothing.

When the clothing to be washed is placed in the washing cylinder of the washing machine, the washing-drying integrated machine can use the RFID recognition system to recognize the tags of clothing and therefore obtain the clothing information.

Step S103: executing a washing program corresponding to the material and/or type of the clothing.

Specifically, after the clothing information is obtained by the washing-drying integrated machine, it can be first compared with saved clothing information of historical clothing in the database to judge whether the clothing belongs to the historical clothing; if yes, the corresponding washing program of the clothing is retrieved from the database, and the selected washing program can be sent to the washing machine for execution; and if not, the above clothing information is sent to a cloud, and the washing-drying integrated machine can download a washing program that matches the clothing from the cloud.

It can be understood that the above washing program retrieved from the database may be a washing program in a historical washing record of the clothing; alternatively, it may be a preset washing program when the clothing information is entered into the local database; the two different kinds of washing programs can both be sent to a display unit of the washing-drying integrated machine for users to choose and execute.

During the execution of the washing program, step S104 is implemented to detect the remaining running time of the washing program.

Specifically, after the washing program is run by the washing machine, an overall preset running time corresponding to the washing program can be obtained; after the washing program has been run for a period of time, when detecting the remaining time of the current washing program, the remaining time of the washing program is the overall preset running time corresponding to the washing program minus an actual running time of the washing program.

After the washing program is selected, the entire running time of the corresponding washing program can be determined. The washing program usually includes a soaking stage, a washing stage, a rinsing stage and a spinning stage executed in sequence, and each stage is run for a fixed period of time.

For example, if the washing program is in the washing stage, the remaining running time of the washing program includes the remaining running time of the washing stage and the preset running time of the rinsing and spinning stages. If the washing program is in the rinsing stage, the remaining running time of the washing program includes the remaining running time of the rinsing stage and the preset running time of the spinning stage.

After the remaining running time of the current washing program is obtained, step S105 can be executed: judging whether the remaining running time of the washing program is smaller than or equal to a preset first time threshold; if yes, proceeding to the next step; and if not, making the clothing dryer enter a standby state.

Specifically, the washing-drying integrated machine is set with a first time threshold, and the first time threshold is compared with the remaining running time of the washing program. If the remaining time of the washing program is smaller than or equal to the first time threshold, step S106 is executed; otherwise, the clothing dryer is started to enter the standby state.

It can be understood that the first time threshold can be larger than a maximum preheating time of each drying program, and time is reserved for the clothing dryer to match the drying program. Through this setting, it is ensured that before the washing machine completes the washing program, the clothing dryer can complete preheating, thus shortening the drying cycle. Of course, the above first time threshold may also be set based on experience, and it is also not necessary to set the first time threshold with reference to the maximum preheating time, as long as the preheating stage of the clothing dryer can be shortened by partial time to achieve the goal of shortening the entire washing-drying cycle.

When it is determined that the remaining running time of the current washing program meets a preset condition, step S106 is executed: matching the clothing dryer with a drying program corresponding to the material and/or type of the clothing.

Specifically, when the remaining running time of the washing program is smaller than or equal to the first time threshold, the clothing dryer is matched a corresponding drying program according to the material and/or type of the current clothing washed, etc.

Since clothing information of historical clothing and its matching historical drying programs are stored in the memory of the washing-drying integrated machine to form a database, when it is required to match the corresponding drying program for the current clothing washed, it can be judged whether the material and type of the current clothing are the same as those of the historical clothing in the database; if they are the same, it is determined that the current clothing washed is the same as the historical clothing in the database, and then the corresponding historical drying program of this clothing can be retrieved from the database and sent to the clothing dryer, that is, the clothing dryer can obtain the historical drying program of the current clothing locally.

If it is determined that the current clothing washed is different from the historical clothing in the database, the clothing dryer can obtain a drying program that matches the current washing program from the cloud. For example, the washing-drying integrated machine uploads the material and/or type of the clothing to the cloud, and the cloud matches a corresponding drying program according to the material and type of the clothing, so that the clothing dryer can download the drying program corresponding to the current clothing washed from the cloud and execute it.

After the drying program corresponding to the current clothing washed is obtained by the clothing dryer, step S107 can be executed: preheating the clothing dryer according to the drying program. Specifically, the drying program of the clothing dryer includes a preheating stage and a formal drying stage. Before the clothing dryer starts the formal drying stage, it needs to go through the preheating stage; during this preheating stage, the clothing dryer can activate a heater and a fan to work and send hot air into the drying cylinder of the clothing dryer, thereby increasing the temperature inside the drying cylinder and achieving a preheating effect.

When the clothing dryer is in the preheating stage, step S108 can be executed: detecting whether the washing program has ended; if yes, sending a clothing drying prompt.

Specifically, the washing-drying integrated machine includes a reminder device that can send a reminder message after the washing program has ended, so as to remind users that the clothing drying program can be executed. Detecting whether the washing program of the washing-drying integrated machine has ended may include the following way: when the washing machine is running its washing program normally, if the preset running time of the washing program is met, then it can be considered that the washing program has ended.

Alternatively, during the normal execution process of the washing program, user intervention occurs. For example, rinsing is paused, or the number of times of rinsing is changed; therefore, an end reminder sound and vibration emitted by the washing machine when it actually completes the washing program can be considered as indicating that the washing program ends. Of course, the reminder sound and vibration can be considered as prompting that the clothing can be dried.

After the user receives the reminder that the clothing can be dried, step S109 is executed: making the clothing dryer execute the drying program in a case where the washed clothing is transferred to the clothing dryer.

Specifically, after the user receives the reminder that the washing program ends, the washed clothing in the washing machine can be transferred to the clothing dryer, so that the clothing dryer executes the above preset drying program; that is, the formal drying stage of the drying program can be executed.

The control method for the washing-drying integrated machine provided by the embodiment of the present disclosure can link the washing machine with the clothing dryer, and according to the remaining time of the washing program, can start the clothing dryer in advance to execute the drying program for preheating, thereby reducing the entire washing-drying time consumption of the clothing, improving the user experience, and meeting the growing intelligentization needs of users.

On the basis of the above embodiment, before implementing step S107 and after implementing step S106, the control method of this embodiment also includes:

Step S100: further detecting the remaining running time of the washing program, and judging whether the remaining running time of the washing program is smaller than or equal to a preset second time threshold; if yes, preheating the clothing dryer according to the drying program; and if not, preparing the clothing dryer for preheating, where the second time threshold is smaller than the first time threshold.

Specifically, the washing-drying integrated machine is set with a second time threshold, and the second time threshold is smaller than the first time threshold; the remaining time of the washing program in this step is compared with the second time threshold, and if the remaining time of the washing program is smaller than or equal to the second time threshold, step S106 is executed; otherwise, the clothing dryer is started to prepare for preheating.

In a specific way of preparing the clothing dryer for preheating, the fan rotates at a low speed and the drying cylinder does not rotate. Correspondingly, in a way of preheating the clothing dryer, the fan operates at a high speed and the drying cylinder rotates. When the remaining time of the washing program is smaller than the second time threshold, the time node thereof is closer to a preheating node of the drying program, and the preparation stage before preheating can be entered. This setting can further detect the remaining time of the washing program, so as to accurately start the node of the drying program and reduce electricity consumption, while also shortening the preheating time of the clothing dryer.

It can be understood that as compared to the first time threshold, the second time threshold can be larger than the maximum preheating time of each drying program, and time is reserved for the clothing dryer to match the drying program. Through this setting, it is ensured that before the washing machine completes the washing program, the clothing dryer can complete preheating, thus shortening the drying cycle.

Further, in order to facilitate monitoring the remaining time of the washing program, the drying program is timely started; in the step S100 above, the further detected remaining running time of the washing program may be the preset running time of the spinning program minus the current running time of the spinning program.

Exemplarily, the washing program selected in this embodiment includes a soaking stage, a washing stage, a rinsing stage and a spinning stage; the drying program can be started in the last stage of the washing program, or in the spinning stage, so as to meet the preheating need of the drying program and also reduce electricity consumption. In order to achieve the above goals, the above remaining running time of the washing program may be the remaining time of the spinning stage, which is the preset running time of the spinning program minus the current running time of the spinning program.

Similarly, in step S105, it is judged whether the remaining running time of the washing program is smaller than or equal to the preset first time threshold; if yes, the method proceeds to the next step; and if not, the clothing dryer enters the standby state; the detected remaining running time of the washing program is the preset running time of the rinsing program minus the current running time of the rinsing program.

Exemplarily, in this embodiment, the clothing dryer can be woken up near the end of the rinsing stage of the washing program, so that the clothing dryer matches the corresponding drying program, thus reserving the preparation time before preheating for the clothing dryer, and providing sufficient time for preheating the clothing dryer. In order to achieve the above goals, the remaining running time in this step may be the preset running time of the rinsing program minus the current running time of the rinsing program.

Hitherto, the technical solutions of the present disclosure have been described in connection with the preferred embodiments shown in the accompanying drawings, but it is easily understood by those skilled in the art that the scope of protection of the present disclosure is obviously not limited to these specific embodiments. Without departing from the principles of the present disclosure, those skilled in the art can make equivalent changes or replacements to relevant technical features, and all the technical solutions after these changes or replacements will fall within the scope of protection of the present disclosure.

What is claimed is:

1. A control method for a washing-drying integrated machine, the washing-drying integrated machine comprising a washing machine and a clothing dryer that are integrated, wherein the washing-drying integrated machine has a washing and drying co-working function key, a RFID recognition system, and a reminder device, and when the washing and drying co-working function key is selected, the washing machine and the clothing dryer can enter a washing and drying co-working mode; and the control method comprises:

recognizing RFID tags of clothing in the washing machine by the RFID recognition system to obtain the material and/or type of the clothing in a case where the washing-drying integrated machine enters the washing and drying co-working mode;

executing a washing program corresponding to the material and/or type of the clothing;

calculating a remaining running time of the washing program by subtracting a current running time of the washing program from a preset running time of the washing program;

judging whether the remaining running time of the washing program is smaller than or equal to a preset first time threshold;

if the remaining running time is larger than the preset first time threshold, keeping the clothing dryer in a powered-on state; and if the remaining running time is smaller than or equal to the preset first time threshold matching the clothing dryer with a drying program corresponding to the material and/or type of the clothing;

preheating the clothing dryer according to the drying program;

determining whether the washing program has ended based on the preset running time;

if the washing program has ended, sending a prompt message by the reminder device to remind the user that the clothing can be dried; and making the clothing dryer execute the drying program in a case where the washed clothing is transferred to the clothing dryer.

2. The control method according to claim 1, wherein the clothing dryer comprises a fan and a drying cylinder, and the fan is used to convey hot air into the drying cylinder; and wherein before the step of preheating the clothing dryer according to the drying program and after the step of matching the clothing dryer with the drying program corresponding to the material and/or type of the clothing, the control method further comprises:

further calculating a new remaining running time of the washing program;

judging whether the new remaining running time of the washing program is smaller than or equal to a preset second time threshold;

if yes, preheating the clothing dryer according to the drying program, wherein the fan operates at a high speed and the drying cylinder rotates; and if not, preparing the clothing dryer for preheating, wherein the fan operates at a low speed and the drying cylinder does not rotate;

wherein the second time threshold is smaller than the first time threshold.

3. The control method according to claim 2, wherein the washing program comprises a spinning program; and in the step of further calculating the new remaining running time of the washing program:

the further calculated new remaining running time of the washing program is a preset running time of the spinning program minus the current running time of the spinning program.

4. The control method according to claim 1, wherein the washing program comprises a rinsing program; and in the step of calculating the remaining running time of the washing program:

the calculated remaining running time of the washing program is a preset running time of the rinsing program minus the current running time of the rinsing program.

5. The control method according to claim 1, wherein clothing information of historical clothing and corresponding historical drying programs are stored in the washing-drying integrated machine; and the step of matching the clothing dryer with the drying program corresponding to the material and/or type of the clothing comprises:

judging whether the material and/or type of the clothing belongs to the historical clothing;

if yes, obtaining a historical drying program of the current clothing locally by the clothing dryer; and if not, obtaining a drying program that matches the current washing program from a cloud storage in communication with the washing-drying integrated machine, by the clothing dryer.

6. The control method according to claim 5, wherein the step of obtaining a drying program that matches the current washing program from the cloud storage by the clothing dryer specifically comprises:

sending the material and/or type of the clothing to the cloud storage; and receiving the drying program corresponding to the material and/or type of the clothing from the cloud storage.

7. A washing-drying integrated machine, wherein the washing-drying integrated machine comprises a memory and a processor, and a control program for the washing-drying integrated machine that can be run on the processor is stored in the memory; and when the control program is executed by the processor, the control method according to claim 1 is implemented.

8. The washing-drying integrated machine according to claim 7, wherein the washing-drying integrated machine further comprises a control unit;

a washing cylinder of the washing machine and a drying cylinder of the clothing dryer are in signal connection with the control unit, respectively; and the control unit can separately control the washing cylinder and the drying cylinder to rotate.

* * * * *